United States Patent [19]

Hartkorn

[11] 3,961,323

[45] June 1, 1976

[54] CARGO MONITOR APPARATUS AND METHOD

[75] Inventor: Albert W. Hartkorn, Hershey, Pa.

[73] Assignee: American Multi-Lert Corporation, Hershey, Pa.

[22] Filed: Dec. 18, 1972

[21] Appl. No.: 315,852

Related U.S. Application Data

[63] Continuation-in-part of Ser. No. 117,410, Feb. 22, 1971, abandoned.

[52] U.S. Cl. ..... 340/280; 340/65; 343/712; 340/224

[51] Int. Cl.[2] ..... G08B 13/02

[58] Field of Search ..... 340/280, 224, 409, 63, 340/64, 65; 343/712; 325/1, 4, 7, 102, 117, 139

[56] References Cited

UNITED STATES PATENTS

| | | | |
|---|---|---|---|
| 3,167,755 | 1/1965 | Larrick et al. | 340/409 |
| 3,257,653 | 6/1966 | McCorkindale | 340/224 |
| 3,478,344 | 11/1969 | Schwitzgebel et al. | 340/224 |
| 3,559,194 | 1/1971 | Bisberg | 340/224 |
| 3,597,753 | 8/1971 | Tabankin | 340/280 |
| 3,618,059 | 11/1971 | Allen | 340/224 |
| 3,618,083 | 11/1971 | Burley et al. | 340/258 A |

FOREIGN PATENTS OR APPLICATIONS

| | | | |
|---|---|---|---|
| 708,799 | 5/1954 | United Kingdom | 343/712 |

*Primary Examiner*—Glen R. Swann, III
*Attorney, Agent, or Firm*—Burns, Doane, Swecker & Mathis

[57] ABSTRACT

A container monitoring system has a small transmitter unit adapted for easy attachment to and removal from a container such as a truck, trailer or railroad car when not in motion and a receiver which alerts a guard as to a theft-related movement either of the container itself or motion into or out of the container, or to a condition within the container such as temperature. The apparatus has provision for transmitting a low power, radio frequency carrier signal, preferably 27 MHz with a wire loop which is mounted to utilize the metallic body of the container as part of the antenna radiation system. The carrier is modulated with a mid-frequency signal that is interrupted at a precisely controlled low frequency rate and has a signal duration of a predetermined different inerval as measured from the theft-related movement. The coding, including the analysis of the signal at the receiver, minimizes false alarms from non-system transmissions on the same carrier frequency and with the same mid-frequency modulation, and permits detection of intentional jamming of the receiver as well as other forms of sabotage to the surveillance system.

20 Claims, 9 Drawing Figures

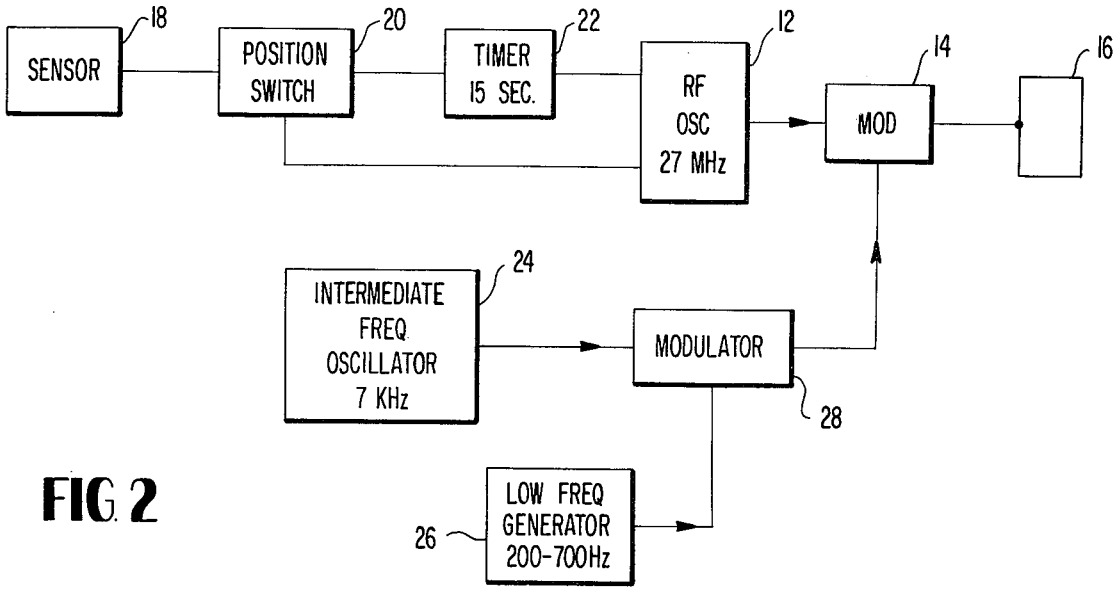
FIG. 2
FIG. 9
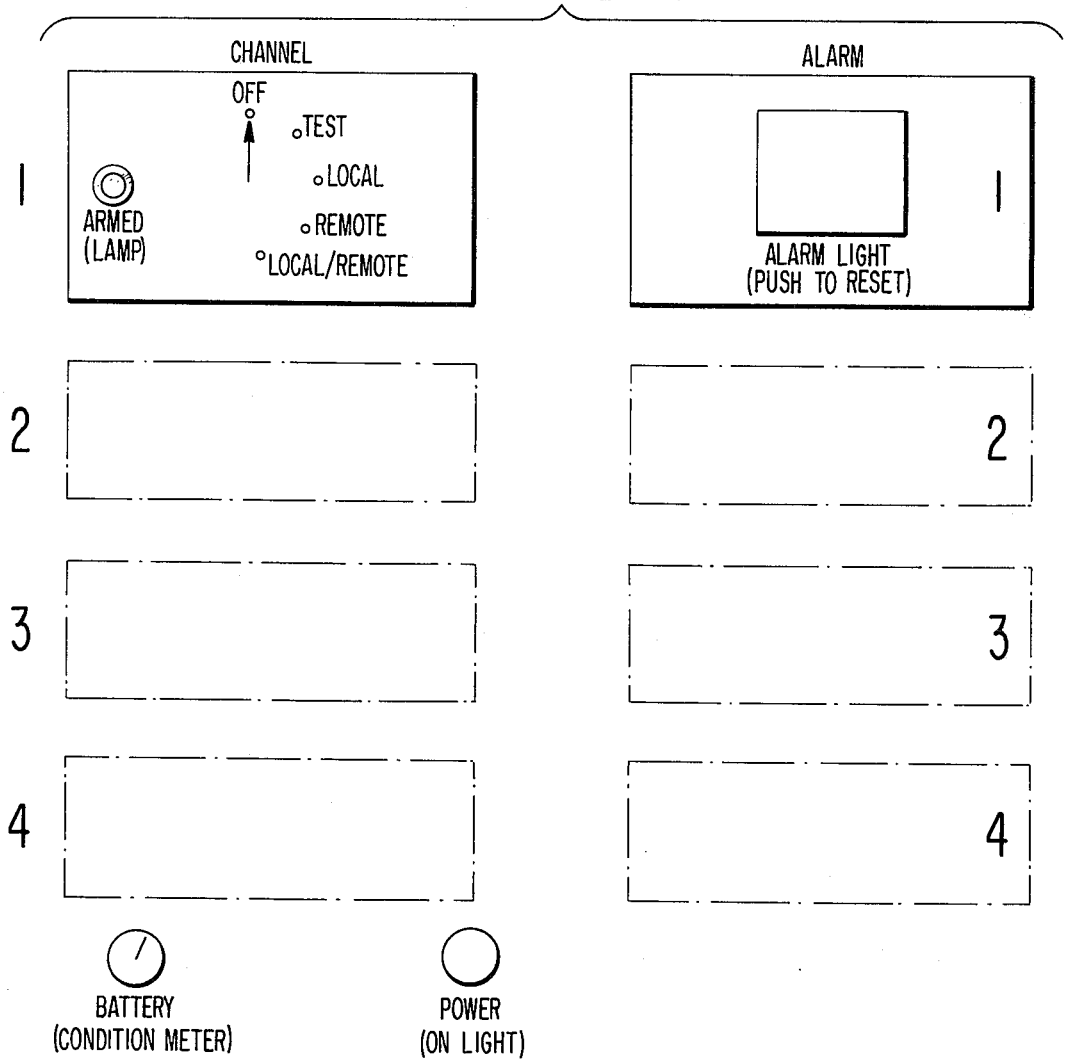

CARGO MONITOR APPARATUS AND METHOD

CROSS REFERENCE TO RELATED APPLICATION

This application is a continuation-in-part of U.S. patent application Ser. No. 117,410, filed Feb. 22, 1971, now abandoned.

BACKGROUND OF INVENTION

This invention relates to improvements in maintaining cargo containers under surveillance, and more particularly to theft preventing apparatus capable of responding to unauthorized movement of, or entry into, various objects, such as trucks, trailers cargo containers, and the like. The invention is especially adapted for use at a truck-trailer depot, railroad yard, or other transportation terminals so as to enable guards and other authorities to respond effectively to any unauthorized movement of the cargo either with or without the container or vehicle or to temperature changes within a cargo container.

In the transportation of goods by truck, by truck-trailer vehicles, or by railroad cars, the bodies or containers are often stored for periods of time in depots or terminals where they await further transfer or movement of the contents into or out of such bodies or containers. The high risk problem which results from such storage makes surveillance essential to the custody or control of the vehicles or containers or their contents.

Personal surveillance has proven too costly and/or ineffective for safeguarding valuable items, particularly cargo during transit or when located at a yard or dock. Locking devices, including padlocks, are not effective as they can be removed or rendered inapplicable by tools and technology in the hands of the criminal element, and the entire container or truck-trailer is frequently transported without authorization from the transportation terminal.

One of the features of the present invention resides in the selection of a carrier wave frequency which is subject to less signal attenuation caused by environmental conditions of freight terminals, yards, docks, and the like which are associated with cargo transportation industries. The commonly used frequencies at 88 or 300 MHz are subject to being attenuated or blocked by intervening metallic structures between the transmitter and receiving antenna, especially at the relatively low power levels which are dictated by the physical size and acceptable cost limitations imposed upon the transmitter units that are adapted to be attached to each cargo container that is placed under surveillance. An external antenna or radiating element, which can be rendered ineffective, will of course destroy the operativeness of the monitoring system, and it is therefore not practical to employ a large antenna.

Since the containers, which may be the trailer for a truck or box car, have widths and heights that are on the order of nine feet, it has been found that by employing a radio frequency carrier signal having a wavelength of approximately four times the dimension of the cargo container, it is possible to utilize a small element which can be contained within the transmitter package in conjunction with the metallic sidewall of the cargo container in a manner such as to immensely increase and enhance the radiation characteristics of the transmitted signal far beyond that which could be produced by the use of a conventional loop type antenna.

Attempts have been made heretofore to monitor and protect selected items with a variety of systems and components, but these have not been considered entirely satisfactory. In some cases, the system failed under the environment of field operating conditions, or because of inherent component inability to monitor specific motions or conditions against which protection is needed. Some systems have an inherently low level of security in protection, constitute violations of Government regulations during operation, or they provide insufficient control over operating personnel to be effective. Elaborate equipment with sophisticated systems involve prohibitive economics that thwart or limit extensive operations by potential users in the transportation industry.

SUMMARY OF INVENTION

One object of this invention, therefore, is to simplify and improve apparatus of this character, to overcome the objections encountered heretofore, and to provide an effective surveillance apparatus.

Another object is to provide a crystal controlled, common radio frequency for all the transmitters in the system and a unique mid-frequency modulation signal that is interrupted at a precisely controlled low frequency to reduce the likelihood of false alarm indications.

Still another object is to employ unique techniques to detect efforts to sabotage the system, as by jamming with a carrier wave of an amplitude sufficient to saturate the receiver, or by disconnecting the receiver station antenna from the receiver equipment.

Yet another object of the invention is thus to utilize a coded radio frequency signal with the carrier having a wavelength approximately four times the size dimension of the height or the width of a metal wall on the cargo container for providing a ground wave signal in order to have reduced attenuation due to the environment in a truck, rail, air, or other transportation terminal, thus allowing the use of a low power transmitted signal, preferably less than 1 watt.

Thus, the cargo container metal wall which is coupled to the transmitter antenna element serves as a quarter wave antenna. The cargo container itself is thus the large antenna and cannot be destroyed or rendered inoperative without triggering the transmitter unit for a time period sufficient to actuate the alarm in the central control station.

The invention thus contemplates, according to one aspect, the use of the carrier having a crystal controlled frequency of 27 MHz which is allocated to the citizens' band. By locating the receiver station in the central region, or immediately adjacent to the transportation terminal, and providing an efficient receiver antenna, the portable transmitter unit may operate with a transmitted power less than 1 watt. In the illustrated system, the transmitter is normally inoperative and when transmission is initiated, the period of transmission is at least 10 seconds but preferably not more than about 30 seconds. This has several advantages in that the receiver at the central station is only busy for a short interval and thus is available to monitor hundreds of transmitters. Also, the power requirements in the portable transmitter unit are minimized so that inexpensive, rechargeable batteries will be adequate.

In conjunction with the relatively low power of the radio frequency signal transmitter unit, the receiver station, as part of the alarm system, can rebroadcast on a different frequency at whatever power level is needed to reach security officers or police who maay be patrolling the area. Since security officers need to be directed only to the zone, or within visual range of the container where the security breach has been detected, it is not necessary that specific identification be carried for each transmitter unit, but only that the transmitter units in a zone be distinguished from other transmitters in the system that are located in another zone.

The invention thus contemplates the modulation of a carrier signal with a mid-frequency signal which, for ease of fabrication and availability of components, may be an audio frequency signal in the range of from 2 to 20 KHz. This mid-frequency signal may then be interrupted by a low frequency signal, preferably on an order of magnitude or more below the mid-frequency signal. By precisely controlling the interruption frequency, the receiver can process the RF signal and the mid-frequency signal in a single section and be provided with a plurality of channels each tuned to separate low frequency interruption signals. Each separate low frequency interruption signal can be used to identify a particular zone in the transportation terminal.

A further feature of the invention thus resides in the use of plug-in units for both the transmitter unit and at the receiver station which are matched as frequency, thereby providing the zone identification and also reducing he likelihood of false production of alarm signals. By requiring the reception of the low frequency interruption signal for a period of 3 or 4 seconds continuously before the alarm is triggered, it has been found that false alarms are avoided, even in metropolitan areas where there is heavy use of the same radio frequency carrier signal frequency.

These objects may be accomplished, according to one embodiment of the invention, by providing a small, lightweight, non-metallic housing containing required circuitry as the transmitter unit to be attached to a door at about the mid-point of a metal sidewall on the object under surveillance, and to transmit a discretely coded signal for a brief period of time, such as 15 seconds, through an antenna system which utilizes the metal surface of the object under surveillance as an integral part of the antenna radiation system. It is preferred to utilize a carrier wave in the citizen's band at about 27 MHz. At the control receiver station, a control console contains all operational controls, a large antenna coupled to a radio receiver having wave analysis circuits and a number of alarm circuits which correspond to the number of zones employed in the installation. The control console is capable of automatically alerting not only the operator on duty, but also automatically rebroadcasting on a different frequency to a supervisory station and to mobile patrol units in the vicinity of the terminal.

These and other objects of the invention will become more fully apparent from the claims, and from the specification and the appended drawings.

BRIEF DESCRIPTION OF THE DRAWINGS

FIG. 2 is a block diagram of the transmitter unit;

FIG. 9 is a diagrammatic illustration of the control console module.

DETAILED DESCRIPTION

Figure 1:
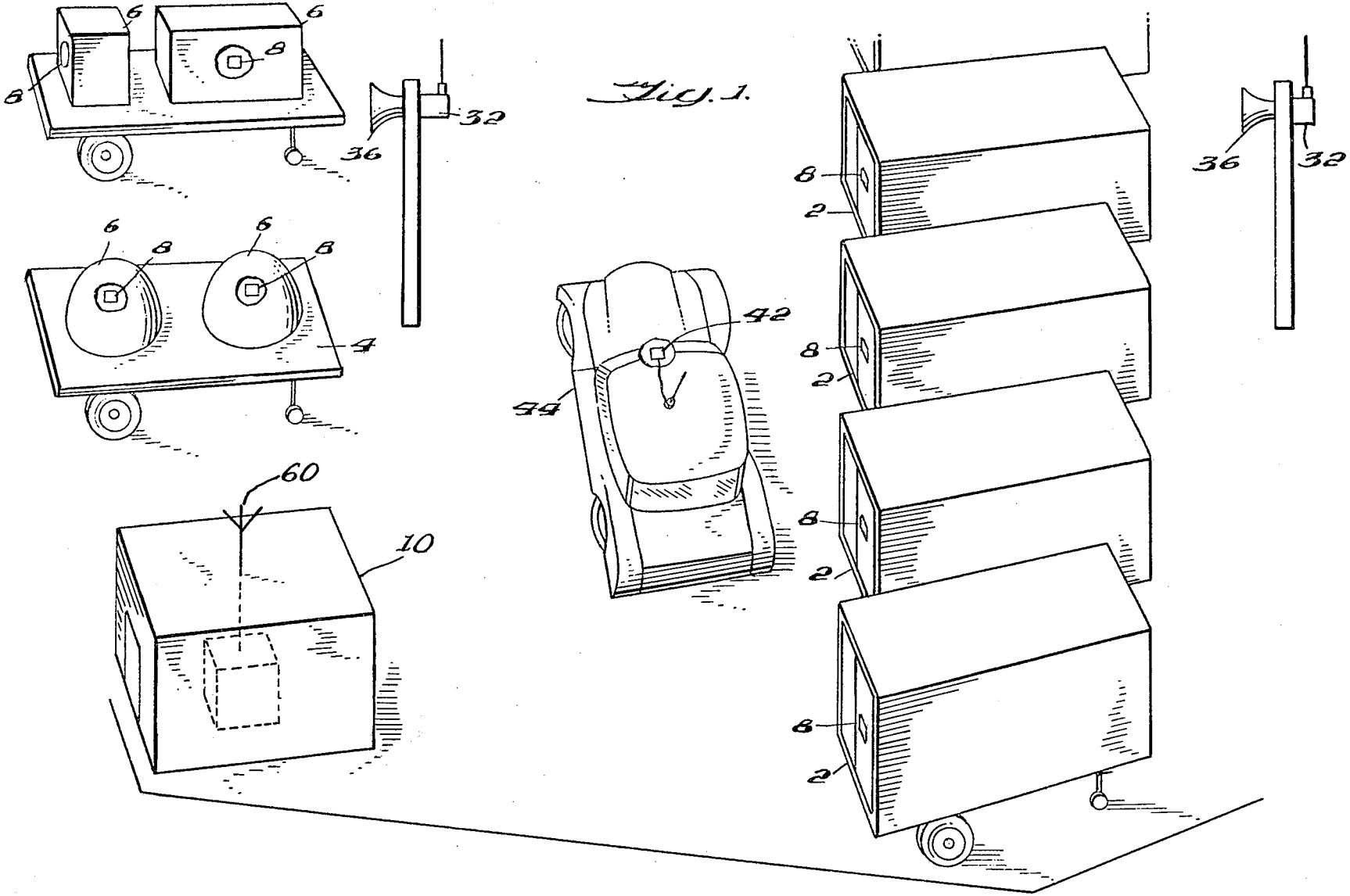
FIG. 1 is a diagrammatic illustration of the installation of a portion of a system utilizing the apparatus and operating in accordance with the method according to this invention.

The invention is illustrated diagrammatically in FIG. 1 as applied to a multiplicity of cargo vehicles and containers and the relation thereof to an appropriate receiver. The cargo containers subject to surveillance by the present invention are all located at a suitable depot or other transfer or storage location for merchandise, or may be in a railroad switching yard. The central receiver station for the terminal may be at any suitable location sufficiently in proximity to the cargo containers as to receive radio frequency signals from the transmitter units on the respective vehicles, rail cars or containers, as will be described below.

As shown in FIG. 1, a transportation terminal often is provided with storage facilities for merchandise and with a loading dock or area where a multiplicity of trailers or bodies of the enclosed type shown at 2, or of the flat bed type shown at 4, may be stored at the depot or yard. It is customary to haul the trailers into place with a transport tractor and to leave these in position for unloading or transfer of the merchandise or to await subsequent shipment. The flat bed trailers 4 are often used to transport containers such as those indicated at 6 within which the merchandise is enclosed. The container or body may be a part of an integrated truck or an entire rail freight car or shipping container. The invention may be applied in the same manner to refrigerated or heated cargo containers and utilized to produce an alarm signal in the event of a detected change in temperature above or below a predetermined value.

When the respective cargo container is brought into the transportation terminal, a separate transmitter device, generally indicated at 8, is adapted to be applied to each trailer, body, or other cargo container. In the case of a truck or box car having loading doors, the transmitter device is supported preferably on the door or door handle so that if there is an unauthorized opening of the doors, as normally occurs during attempted robbery of the contents by way of the doors, the movement of the doors will be detected.

A motion detector in the transmitter device may be in the form of a pendulum switch which can be set at a predetermined response period. An example of a suitable form of pendulum switch found effective for this purpose is illustrated in Scoville patent, U.S. Pat. No. 3,674,950, granted July 4, 1972.

Alternatively, in applications where a refrigerated container is to be monitored to detect any rise in temperature above a predetermined level, a simple bimetal temperature sensing element with switch contacts may be used to initiate operation of the transmitting unit.

Two transmitter units may be employed on the same cargo container, one for monitoring the security of the container and the other the temperature maintained within the container.

With continued reference to FIG. 1, the receiver at the central station 10 may include an antenna 60 and a console as described in connection with FIG. 9. The receiver station 10 is not ordinarily within visual sight of the cargo containers. Each of the transmitter units 8 is adapted to operate on the same carrier frequency. Normally, there is no RF transmission from any transmitter.

Upon receipt of a brief transmission of 15 seconds, for example, from any transmitter 8, the central station 10 not only produces internal alarms, but rebroadcasts a new alarm signal which can be used to activate other alarms 32 which may have loudspeakers 36, or to alert patrol cars 44 that are equipped with special receivers 42.

FIG. 2 shows a block diagram of the circuit in the transmitter 8 of FIG. 1. The carrier wave oscillator 12, which may be of any suitable construction, produces an output signal which is fed to modulator 14 and to loop antenna 16. This circuit produces a transmitted signal at a low level, such as a fraction of a watt. Oscillator 12 is normally off.

Sensor 18 is connected to oscillator 12 through a position switch 20. If the position switch 20 is in its normal position, control of oscillator 12 is by a timer 22. However, if the sensor 18 is improperly mounted so that position switch 20 is in its alternate condition, oscillator 12 will operate continuously. The person installing the transmitter 8 carries a receiver tuned to the carrier frequency, and reception of a continuous output carrier signal indicates that the installation is improper. On the other hand, if the carrier turns off after the 15 second interval, this indicates to the person installing the transmitter unit 8 that the installation is proper.

To provide security of the system, the carrier signal is modulated by a mid-frequency signal from oscillator 24. The frequency of the signal from oscillator 24 is not critical, and to provide ease of monitoring by the person installing the transmitter units 8, an audio frequency is used. It is convenient to use an audio frequency of from about 2 to 20 KHz. In the illustrated embodiment, a 7 KHz tone is used.

A low frequency generator 26 is used to produce a signal to modify the mid-frequency tone in modulator circuit 28. The frequency of the output signal from generator 26 should be at least one order of magnitude less than the frequency from the intermediate frequency oscillator 24. In the illustrated embodiment, frequencies in the range of 200 to 700 Hz may be used.

The audio frequency tone in the transmitter is interrupted at a frequency corresponding to the frequency of the signal from low frequency generator 26. The person installing a transmitter 8 when monitoring the transmitter can hear a low frequency sputter in the audio frequency signal.

Figure 3:
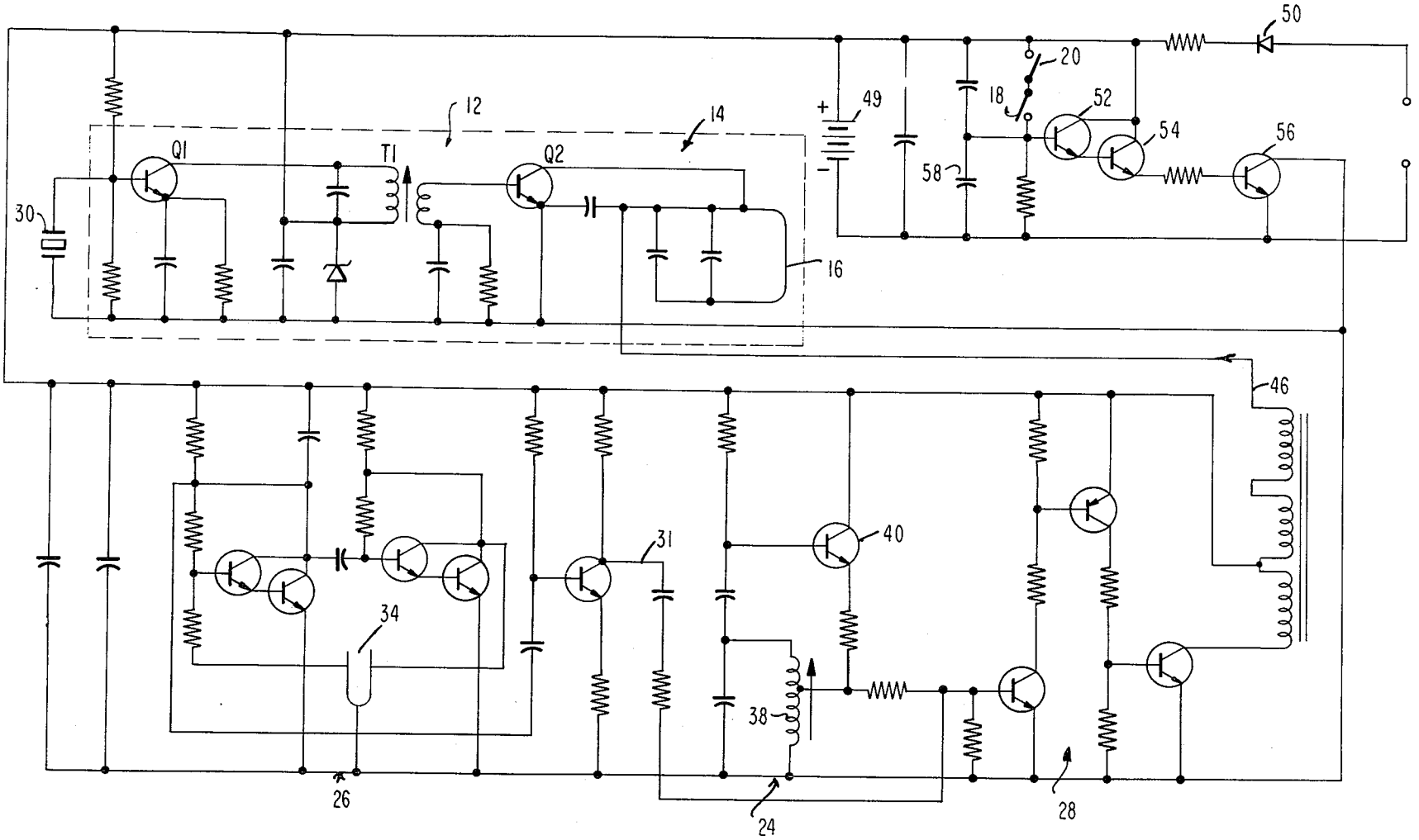
FIG. 3 is a schematic circuit diagram of a preferred embodiment of the transmitter circuit of FIG. 2.

FIG. 3 is a circuit diagram of the transmitter unit 8 which is a preferred embodiment of the block diagram of FIG. 2. The radio frequency oscillator 12 includes crystal 30, transistor Q-1, and tank circuit including Transformer T-1. Mid-frequency oscillator 24 may be any suitable audio oscillator and include coil 38 and transistor 40.

The low frequency generator 26 includes a plug-in unit 34 which may be a crystal controlled tuning fork. Such tuning forks are commercially available and can be factory tuned to any frequency between about 300 and 900 Hz at an operational accuracy of ±3 Hz. Alternately, other equivalent low frequency generators, such as conventional flip-flops, may be used. To have the zone identification feature of the present invention, it is desirable to have the capability to provide a unique frequency for each zone. The output signal on lead 31 is applied to modulate, be mixed with, or interrupt the output signal from the mid-frequency oscillator 24 in modulator 28.

Modulator circuit 28 is of a known type and provides the combined mid-frequency and low frequency signals on lead 46 for modulating the carrier wave frequency in the output circuit of transistor Q-2. The output circuit is connected to a suitable antenna which, in the illustrated embodiment, is preferably an wire loop 16. Loop 16 may comprise a length (20 to 24 inches) of heavy copper wire (No. 12 gauge) and be part of the installation as described in connection with FIG. 7.

Referring now to the upper right corner of FIG. 3, the circuit for the sensor 18 includes switch contacts which are normally open and are closed upon detection of the condition to be sensed.

Contacts 20 are normally closed when the transmitter unit 8 is mounted on a cargo container, but are opened when the transmitter unit 8 is oriented in a position which will prevent sensor contacts 18 from operating properly.

Battery 49, which is rechargeable through a circuit including diode 50 when the transmitter unit is not in use, is connected through contacts 18 and 20 to transistors 52, 54 and 56. When transistor 56 conducts, the battery voltage is applied to the entire circuit of the transmitter unit 8, and capacitor 58 is charged. After contacts 18 are opened, the circuit remains in a transmitting condition for about 15 seconds while capacitor 58 discharges, after which transmission from the transmitter unit 8 is discontinued.

Figure 4:
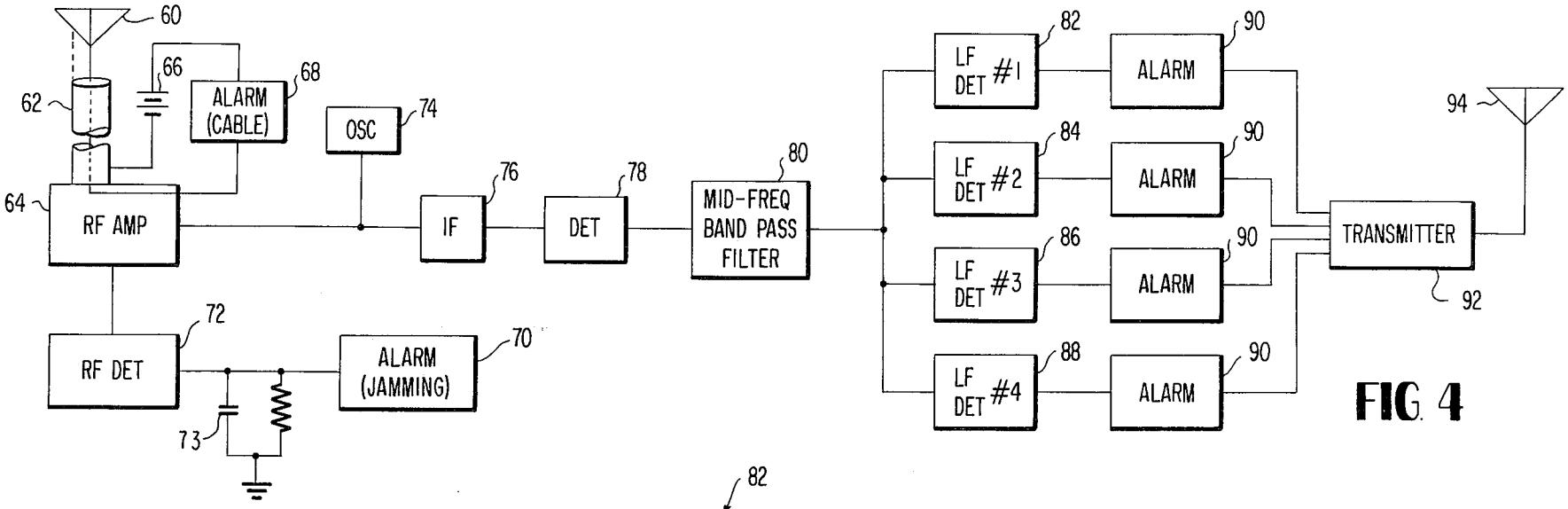
FIG. 4 is a block diagram of the central receiver station.

Referring now to FIG. 4, a block diagram of the receiver is illustrated which has an antenna 60 that is of a conventional construction to efficiently receive the transmitted carrier frequency. Antenna 60 is connected to the RF section of the receiver by a coaxial cable 62. At the receiver near RF amplifier stage 64, a battery 66 is connected in series with a cable alarm 68 and to both the inner and the outer conductors of cable 62. The two conductors are galvanically connected together through the antenna 60 and the circuit is thus completed. However, in the event the system is damaged, intentionally or otherwise, through disconnection of cable 62 from either antenna 60 or RF amplifier 64, alarm 68 is energized. This alarm 68 may also be monitored at a supervisory station remote from the central receiving station near the freight terminal.

Additional protection against saturation of the receiver of FIG. 4 through transmission of a high power signal at the system frequency is provided by jamming alarm 70. This feature of the invention may be provided by connecting an RF detector 72 to monitor the signal level of the signal received by RF amplifier 64. If a high level signal is received for a period of several seconds, capacitor 73 can be charged sufficiently to activate the jamming alarm 70.

Figure 6:
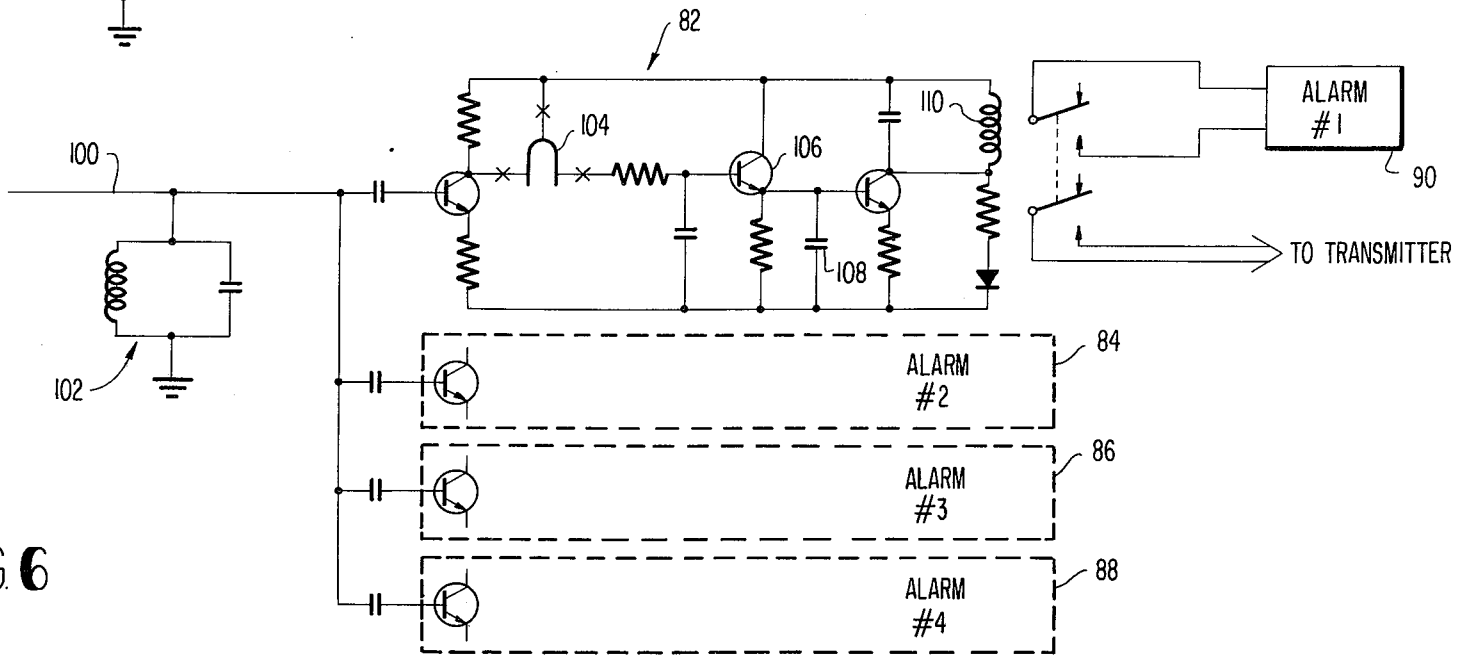
FIG. 6 is a circuit diagram of the mid-frequency and low frequency detector section.

For analysis of the radio frequency signal received at RF amplifier 64, oscillator 74 is used to produce an IF frequency which is amplified at IF stage 76 and the modulation analyzed by detector 78 and mid-frequency bandpass filter 80. The mid-frequency signal passed by filter 80 is analyzed by each of the low frequency detector stages 82, 84, 86 and 88 for the particular low frequency signal to which it is tuned by a separate plug-in unit, as illustrated in FIG. 6.

Each of the low frequency detectors 82–88 of FIG. 4 may be used to identify the particular transmitter, or a particular zone in the freight terminal, from which a transmitted signal if received. The associated alarm 90 at the central receiver station is thereby activated, and in accord with another feature of the invention, an alarm signal is also broadcast over an annunciator by transmitter 92 and antenna 94.

Transmitter 92 operates at a specially assigned frequency different from the system frequency utilized by antenna 60. Also, its power is preferably several watts, to be picked up by guards or law enforcement officers patrolling the area.

Figure 5:
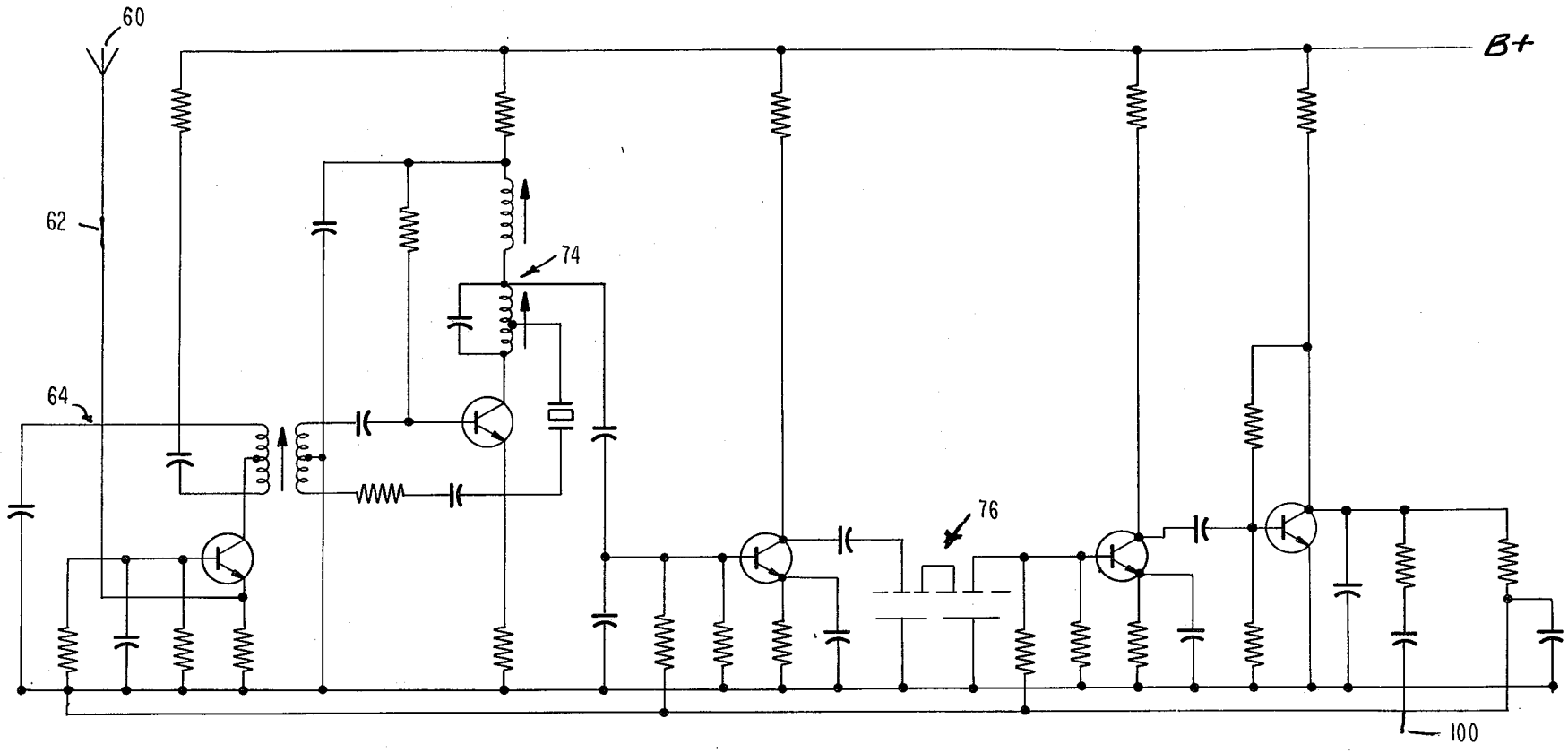
FIG. 5 is a circuit diagram of the RF and IF receiver sections.

Referring now to FIG. 5, the details of the RF and IF portions of the receiver are shown. The incoming RF signal from any activated transmitter unit 8 is received by antenna 60 and processed by RF amplifier 64, local oscillator 74, and IF amplifier stages 76, all of which, as shown, are of conventional construction, and thus further description here is believed unnecessary. The output signal is on lead 100.

Referring to FIG. 6, the signal on lead 100 is processed by a bandpass filter 102 tuned to exclude all freqencies except the mid-frequency signal, which carries the low frequency modulation, or more precisely in the illustrated embodiment, the interruprion frequency. The output signal from filter 102 is thus applied to each of the low frequency signal detectors 82, 84, 86 and 88.

Each low frequency detector is shown to include a crystal controlled tuning fork, which is available as a plug-in unit 104. This unit 104 is preferably identical to the plug-in unit 34 used in the transmitter circuit of FIG. 3. Where the interruptions of the mid-frequency signal, here described as being 7 KHz, occur at the rate to which the plug-in unit 104 is tuned, an alternating volgage signal is produced which controls conduction through transistor 106. After reception of a signal for a period of 3 or 4 seconds, the charge on capacitor 108 changes so that the current conduction condition through relay coil 110 changes, and the associated switch contacts are closed. This closure actuates the alarm 90 and can be used to activate tne annunciator feature, as discussed above.

As each of the other low frequency detectors operate in the same fashion as just described, it is apparent that the unique alarm signal for each zone will be produced only when the appropriate signal is transmitted and that the system is substantially free of false alarm conditions resulting from spurious transmissions.

Figure 7:
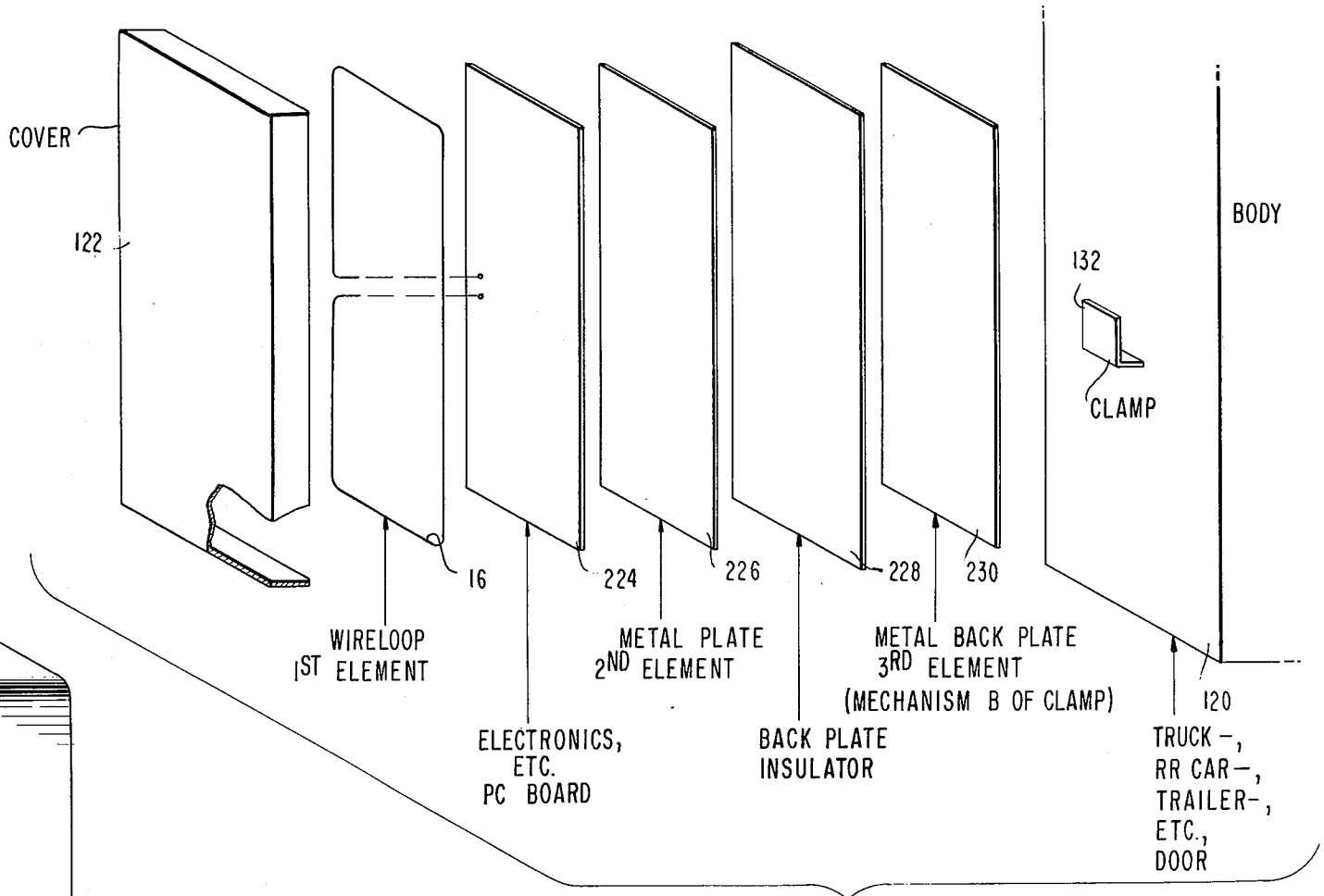
FIG. 7 is a diagrammatic view of the antenna radiation system.
Figure 8:
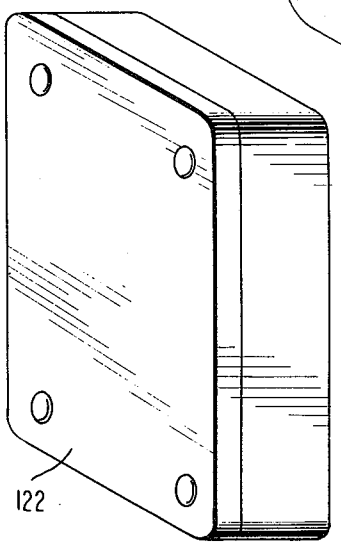
FIG. 8 is a perspective view of the enclosed transmitter.

It is preferred to utilize a transmitter unit 8 having an antenna in the form of a radiation system which is shown diagrammatically in FIG. 7. The transmitter unit 8 is located within the confines of the casing comprising a cover 122 and an insulator back plate 228.

This radiation system at the fractional watt power level and carrier frequency of about 27 MHz that is preferred and has a wavelength approximately four times greater than the width and/or height of the metal walled cargo container, essentially transforms the truck, vehicle, or container in whatever form to which the sensor-transmitter casing is attached, as by the clamp means described above, into a large antenna. The vehicle body or container becomes a radiating element of the antenna system driven by the wire loop 16. The radiation pattern is isotropic. The spacing between the sensor-transmitter casing and the central portion of a metallic surface of the object to which it is attached is determined by the clamp structure or attaching means. A direct electrical connection between the metal back plate 230 of the casing and the container or body generally illustrated at 120 in FIG. 7 and shown also 2 in FIG. 1 is not required.

The elements of the radiation system constituting the antenna are shown diagrammatically in FIG. 7 and those in addition to body 120 are located within the cover 122. These include a wire loop, illustrated at 16, which is directly connected electrically to conductors on the PC board 224 (FIG. 7) and coupled through a printed circuit board 224 to a metal plate 226. A back plate insulator 228 is interposed between the plate 226 and a metal back plate 230, which forms a supporting plate for the clamp connector 132. As shown in FIG. 7, the area within the wire loop is approximately the same as the areas of the metal plate 226 and metal back plate 230.

While cargo containers have similar metallic and dimensional characteristics, especially in the case of box cars, trucks, trailers, etc., placing the sensor on another type of surface, as illustrated for example in FIG. 1, will cause the wire loop 16 to couple to plates 226 and 230 as described above, causing radiation in a pattern similar to that of a ½ wave dipole pattern and with a signal strength greater than that of a normal loop-type antenna.

The transmitter unit 8 produces a crystal controlled carrier modulated by an intermediate frequency (7 KHz) and by a low frequency (400 Hz) of extremely narrow band ( $\pm$ 3 Hz ), with a precise control of carrier "On" time to be at least 10–30 seconds even though the sensor contacts close only momentarily.

The control console at the central station as illustrated in FIG. 1 is shown diagrammatically in FIG. 9. This console should be housed in an approved cabinet with suitable automatic alarm circuit in the event of opening of the cabinet. The control console, as illustrated, includes four channels which may be correlated with different zones to be monitored, each capable of responding to a large number of transmitter units 8. The alarms for each of the channels or zones are shown as indicated. The desired system testing capability and means for generating alarm signals as indicated may also be provided, if desired.

The control console of FIG. 9 performs the function of receiving and analyzing incoming radio signals to identify any system transmitter units. It also functions as an alarm itself. In addition, it may transmit a new alarm signal through an additional system. The preferred embodiment has two independently operating alarm systems to accomplish this later function, one of which is a radio and the other is a land line. Thus, a high degree of security is achieved.

By continuously monitoring the signal duration, strength and information content, the control console will distinguish effectively between different incoming signals, namely, the signal of interest transmitted by a system transmitter unit, the spurious signal from one or more outside transmitters which may temporarily contain the precise intermediate and even the low frequency signals, or a jamming RF signal from one or more transmitters, which may or may not contain the presise coding.

Simplicity of design permitting lowest cost fabrication, assembly, quality control, and testing, has allowed system costs to fall within the budget of even the smallest cargo forwarder. In addition, human factor analyses contributing to the lowest weight and smallest size consistent with required operational constraints has brought operating costs to a minimum. For example, the system can be fully operated by any job classification (considering sound security practices) without interfering with the duties of the job classification, and in most cases, releasing the individual to more easily achieve these duties.

These necessary considerations are not found in prior systems where:

a. The operator must carry and use a variety of tools, and spend excessive time in attaching one transmitter and package to the body to be monitored.
b. Functional controls are complex and/or time consuming to operate
c. The operator must continually respond to alarms that are, in fact, the result of:
   1. Vibrations
   2. Wind
   3. Normal movement of monitored object
   4. Normal movement of other objects (vehicles)
   5. Radio transients (Phantoms).

While the invention has been illustrated and described in one embodiment, it is recognized that variations and changes may be made therein without ddeparting from the invention as claimed.

What I claim is:

1. Cargo container monitoring system comprising:

a plurality of transmitter units each adapted for separate attachment to different cargo containers and each comprising:

a radio frequency oscillator and antenna;

means for generating a mid-frequency signal and for modulating the signal from said radio frequency oscillator;

circuit means operating at a low frequency up to about 1000 Hz connected to continuously interrupt said mid-frequency signal and including a device for controlling frequency of said interruptions with sufficient precision to enable a transmitter unit to be distinguished from other transmitter units in the system; and a sensing element connected to cause initiation of a transmitter signal;

and a receiver station having an antenna adapted to receive signals from a transmitter antenna and comprising:

a radio frequency section connected to said antenna;

circuit means including a bandpass filter for passing said mid-frequency signal connected to receive an output signal from said radio frequency station;

a circuit including a frequency selective unit connected to receive an output signal from said bandpass filter responsive only to the interruption rate at said low frequency of said mid-frequency signal for selectively producing a signal; and an alarm circuit connected to be actuated in response to the signal from said frequency selective unit.

2. The monitoring system according to claim 1 wherein the receiver station includes a plurality of circuits connected to receive the output signal from said band-pass filter with each circuit having a separate frquency selective unit to produce an output signal in response to a different low frequency interruption rate, and a separate alarm circuit connected to be actuated by the output signal from a respective frequency selective unit.

3. The monitoring system according to claim 2 comprising a plurality of cargoes located in groups with each group defining a different zone and wherein all of the frequency interruption control devices associated with the transmitters attached to the cargoes in each zone operate at the same interruption rate and one of each of said separate alarm circuits corresponds to one of each of said zones.

4. The monitoring system according to claim 1 wherein the receiver station antenna is connected to the radio frequency section by a coaxial cable including a central conductor and outer grounded sheath and wherein said receiver station further comprises means for detecting a break in said cable comprising a source of voltage, an electrical current indicator, and means for connecting said indicator .to said voltage source through a circuit including the central conductor and the outer sheath of said cable and the cable connection to said antenna.

5. The monitoring system according to claim 1 wherein each of said transmitter units has an output signal power less than about one watt at a predetermined radio frequency and the receiver station includes means for detecting jamming of the system comprising a jamming alarm connected to a signal level detector actuated in response to the detection of said predetermined radio frequency at a signal level in excess of that produced by a nearby one watt transmitted signal over an interval of time greater than about 3 seconds.

6. The monitoring system according to claim 1 wherein the alarm circuit further includes an alarm element and a timing circuit connected to receive the signal from said frequency selective unit, said timing circuit requiring the continuous presence of the signal from said frequency selective unit for a period of at least 3 seconds before producing a signal for actuating said alarm element.

7. The monitoring system according to claim 1 wherein each transmitter unit is in a separate housing containing a power battery, said radio frequency oscillator, said mid-frequency signal generating means, said low frequency circuit means and said sensing element, and wherein the sensing element includes a switch contact that is normally open but which is closed momentarily when subjected to an acceleration force, and the transmitter unit further comprises in said housing a timing circuit connected to be initiated in response to opening of said switch contact to limit the period of a transmitted signal to a predetermined time interval to have a duration between about 12 and 30 seconds.

8. The monitoring system according to claim 7 wherein each of said transmitter units has an output signal power less than about 1 watt at a frequency of approximately 27 MHz and a radiation system having a plurality of elements of conductive material mounted in spaced planes substantially parallel to a metal surface of said cargo container, said metal surface having a height and width of approximately 9 ft. and one of said radiation system elements comprises a loop of wire free of any direct electrical connection to the metal surface of the cargo container and having a size greater than 14 gauge; and the receiver station antenna is connected to the radio frequency section by a coaxial cable including a central conductor and outer grounded sheath with the receiver station further comprising means for detecting a break in said coaxial cable comprising a source of voltage, an electrical current meter, and means for connecting said meter to said voltage source through a circuit including the central conductor and the outer sheath of said coaxial cable and the cable connection to the antenna; and wherein said radio frequency section includes means for detecting jamming of the system comprising a jamming alarm connected to a signal level detector actuated in response to detection of the transmitted signal at a signal level in excess of that produced by a nearby 1 watt transmitted signal over an interval of time greater than about 3 seconds.

9. Cargo container monitoring system comprising:

a plurality of transmitter units each adapted for separate attachment to different cargo containers which have a door having a metal surface through which cargo is adapted to be loaded and unloaded and each comprising:

a radio frequency oscillator and antenna radiation system having a plurality of elements of conductive material in spaced planes substantially parallel to each other and to the metal surface of said door, and the transmitted radio frequency signal has a wavelength which is approximately four times the width or height of the metal surfaces of a container wall having said door;

means for generating a mid-frequency signal and for modulating the signal from said radio frequency oscillator;

circuit means operating at a low frequency up to about 1000 Hz connected to momentarily interrupt said mid-frequency generator signals and including a plug-in device for controlling frequency of said interruptions with sufficient precision as to enable a transmitter unit to be distinguished from other transmitter units in the system;

a sensing element connected to cause initiation of a transmitter signal;

and a receiver station having an antenna adapted to receive signals from a transmitter antenna and comprising:

a radio frequency section connected to said antenna;

circuit means including a bandpass filter for passing said mid-frequency signal connected to receive an output signal from said radio frequency station;

a circuit including a frequency selective plug-in unit connected to receive an output signal from said bandpass filter responsive to the interruption rate of said mid-frequency signal for selectively producing a signal; and an alarm circuit connected to be actuated in response to the signal from said frequency selective unit.

10. The monitoring system of claim 9 wherein one of the transmitter radiation system elements comprises a loop of wire free of any direct electrical connection to the metal surface of the cargo container and having a size greater than 14 gauge, the height and width of the metal surface container wall are both approximately nine feet, and the transmitted frequency is approximately 27 MHz.

11. A cargo container monitoring system characterized by having separate transmitter units attached to different cargo containers with each of said transmitter units having an output signal power less than about one watt at about 27 MHz, said transmitter units being normally de-energized, a motion responsive unit for each transmitter unit for energizing the transmitter unit, means for limiting the duration of each transmitted signal from said transmitter unit to a period of between about 12 and 30 seconds after cessation of a motion which caused energization of said transmitter unit, and a central station located in the vicinity of but remotely from said containers has a receiver with an incoming radio frequency signal level detector responsive to signals at about 27 MHz, and means for detecting jamming of the system including a jamming alarm connected to a signal level detector actuated in response to the detection of radiation energy at about 27 MHz having a signal level in excess of that produced by a nearby one watt transmitted signal over an interval of time greater than about 3 seconds.

12. A cargo container monitoring system characterized by having separate transmitter units attached to different cargo containers with each cargo container having a door with a metal surface through which cargo is adapted to be loaded and unloaded, and each of said transmitter units having a radiation system including a plurality of elements of conductive material mounted in spaced planes substantially parallel to the metal surface of said door, and an output signal power less than about one watt at about 27 MHz to have a wavelength approximately four times the width or height of the metal surface of a container wall having said door, said transmitter units being normally de-energized, a motion responsive unit for each transmitter unit for energizing the transmitter unit, means for limiting the duration of each transmitted signal from said transmitter unit to a period of between about 12 and 30 seconds after cessation of a motion which caused energization of said transmitter unit, and a central station located in the vicinity of but remotely from said containers having a receiver with an incoming radio frequency signal level detector responsive to signal at said about 27 MHz, and means for detecting jamming of the system including a jamming alarm connected to a signal level detector actuated in response to the detection of radiation energy at said about 27 MHz having a signal level in excess of that produced by a nearby one watt transmitted signal over an interval of time greater than about 3 seconds.

13. The monitoring system of claim 12 wherein one of the transmitter radiation system elements comprises a loop of wire free of any direct electrical connection to the metal surface of the cargo container and having a size larger than 14 gauge, and the height and width of the metal surface of said container wall are approximately nine feet.

14. An alarm system for monitoring a plurality of movable objects each of which has a wall with a substantially flat metal surface, the system comprising a plurality of transmitter units each including means for mounting the transmitter unit on one of the objects, means for transmitting a coded radio frequency signal from each respective transmitter unit upon movement of the object to a predetermined extent, said flat metal surface on said object having a dimension that is approximately one fourth of the wavelength of said radio frequency signal and the transmitter unit being mounted adjacent said metal surface at the approximate midpoint of said dimension, said radio frequency signal including an intermediate frequency modulation signal that is precisely controlled by a low frequency, narrow band modulation signal unique to each of said plurality of transmitter units, and a receiver including means for detecting the unique signals from the plurality of transmitter units and an alarm means responding only to the presence of the low frequency modulation signal.

15. An alarm system for monitoring a plurality of movable objects, comprising a plurality of transmitter units each including means for mounting the transmitter unit on one of the objects, means for transmitting a coded radio frequency signal from each respective transmitter unit upon movement of the object to a predetermined extent, said radio frequency signal including an intermediate frequency signal that is further modulated by a narrow band modulation signal having a frequency less than 1000 Hz that is generated by a crystal controlled tuning fork and unique to each of said plurality of transmitter units, and a receiver including means for detecting the unique signals from the plurality of transmitter units comprising a band pass filter for passing said intermediate frequency signal and a plurality of detector circuits each containing a separate crystal controlled tuning fork operative at different frequencies corresponding to different frequencies generated by the crystal controlled tuning forks in said transmitter units, an an alarm means responding only to the presence of a tuning for, frequency signal.

16. An alarm system according to claim 15, wherein the low frequency modulation signal is precisely controlled to within ± 3 cycles.

17. A method of maintaining mobile cargo containers under surveillance while stored in a transportation terminal having a central station including a console with a plurality of alarm devices by use of a wireless radio system comprising:

removably attaching a battery powered transmitter unit to the door of the cargo container while the cargo container is located in the transportation terminal;

positioning a transmitter antenna element along a central portion of the container metal side wall having a dimension of approximately nine feet;

providing a transmitter circuit in said transmitter unit having a maximum power output of less than about 1 watt;

operating said transmitter circuit to generate a radio frequency signal having a wavelength approximately four times greater than said dimension of said container sidewall to thereby utilize the cargo container as a radio frequency radiating element for the transmitter unit; and removing said transmitter unit from the cargo container when the cargo container is to be no longer under surveillance.

18. A method of maintaining mobile cargo containers under surveillance when stored in a transportation terminal by use of a wireless radio system comprising:

removably attaching a battery powered transmitter unit to a cargo container under surveillance while the cargo container is located in the transportation terminal adjacent a central monitoring station;

energizing the transmitter circuit in response to a variation of a condition being monitored for a brief period of at least 10 seconds and otherwise maintaining the transmitter circuits in a non-operating condition;

modulating a carrier signal which for all the transmitters in the system is at the same radio frequency with a mid-frequency signal that is also substantially the same for all transmitted signals for the transmitters in the system;

interrupting the mid-frequency signal at a predetermined low frequency less than about 1000 Hz generated by a first circuit means controlling said low frequency to be within about ±3Hz of a predetermined value;

detecting at the receiver station the interruption at the predetermined low frequency rate of the mid-frequency signal by a second circuit means substantially identical to said first circuit means;

generating an alarm at the central station only in response to the detection of the interruption at the predetermined low frequency rate of the mid-frequency signal for a preselected minimum time interval to thereby prevent false alarm signals from other carrier waves containing said mid-frequency signal; and removing said transmitter unit from the cargo container when the cargo container is to be no longer under surveillance.

19. A method of maintaining mobile cargo containers having a metal sidewall with a predetermined dimension under surveillance when stored in a transportation terminal by use of a wireless radio system comprising:

removably attaching a battery powered transmitter unit near a center portion of the metal side wall of a cargo container under surveillance while the cargo container is located in the transportation terminal adjacent a central monitoring station;

utilizing the cargo conainer as a radiating element for the transmitter carrier wave;

energizing the transmitter circuit to generate a carrier wave frequency having a wavelength that is approximately four times greater than said container sidewall dimension in response to a variation of a condition being monitored for a brief period of at least 10 seconds and otherwise maintaining the transmitter circuits in a non-operating condition;

modulting a carrier signal which for all of the transmitters in the system is at the same radio frequency with a mid-frequency signal that is also substantially the same for all transmitted signals for the transmitters in the system;

interrupting the mid-frequency signal at a predetermined low frequency rate;

detecting at the receiver station and generating an alarm at the central station in response to the detection of the interruption at the predetermined low frequency rate of the mid-frequency signal for a preselected minimum time interval to thereby prevent false alarm signals from other carrier waves containing said mid-frequency signal; and removing said transmitter unit from the cargo container when the cargo container is to be no longer under surveillance.

20. The method according to claim 19 wherein the carrier frequency of all the transmitter units in the system is approximately 27 MHz, the mid-frequency signal has a frequency in the range of from 3 to 20 KHz, and the frequency of the interrupting signal is in the range of 200 to 800 Hz.

* * * * *